United States Patent [19]

Edell

[11] 4,328,894

[45] May 11, 1982

[54] DISPLAY CLIP FOR SECURING CONTAINER SO AS TO PRECLUDE TAMPERING THEREWITH

[75] Inventor: Morton Edell, West Orange, N.J.

[73] Assignee: Hazel Bishop Industries, Inc., Kenilworth, N.J.

[21] Appl. No.: 163,341

[22] Filed: Jun. 26, 1980

[51] Int. Cl.[3] ..... B65D 73/00

[52] U.S. Cl. ..... 206/461; 206/471; 206/481

[58] Field of Search ..... 206/461–471, 206/478, 481; 220/320

[56] References Cited

U.S. PATENT DOCUMENTS

| | | | |
|---|---|---|---|
| D. 90,683 | 9/1933 | Sadacca . | |
| D. 180,110 | 4/1957 | Slater . | |
| 435,022 | 8/1890 | Robinson . | |
| 1,107,509 | 8/1914 | Foster . | |
| 2,401,615 | 6/1946 | Chittum . | |
| 2,629,830 | 2/1953 | Calhoun et al. . | |
| 2,714,469 | 8/1955 | Carlson | 220/320 |
| 2,854,135 | 9/1958 | Pantalone . | |
| 2,959,276 | 11/1960 | Srofe . | |
| 3,003,620 | 10/1961 | Srofe . | |
| 3,139,182 | 6/1964 | Edell . | |
| 3,404,774 | 10/1968 | Levine | 206/471 |
| 3,463,307 | 8/1969 | Caplan . | |
| 3,698,551 | 10/1972 | Tomlinson . | |
| 3,762,545 | 10/1973 | Warner et al. . | |
| 3,764,002 | 10/1973 | Speigel et al. | 206/471 |
| 3,809,226 | 5/1974 | Ferrari . | |
| 3,869,043 | 3/1975 | Warner et al. . | |
| 3,927,765 | 12/1975 | Beal . | |
| 4,023,759 | 5/1977 | Perkins . | |

*Primary Examiner*—William T. Dixson, Jr.
*Attorney, Agent, or Firm*—Fleit & Jacobson

[57] ABSTRACT

A display clip for securely mounting a container of at least two parts to a display card comprises a front surface portion for preventing movement of the container away from the display card in a direction perpendicular to the plane of the display card, side surface portions for preventing movement of the container horizontally in a direction parallel to the plane of the display card, a pair of flange projecting portions disposed at the uppermost and lowermost extremities, respectively, of the display clip for coacting with respective built up portions on the container for preventing vertical movement of the container in a direction parallel to the plane of the display card, as well as for preventing separation of the portions of the container. In a preferred embodiment, the upper and lower flange projecting portions surround and coact with built up portions on the cover and barrel portion, respectively, of the container.

8 Claims, 5 Drawing Figures

DISPLAY CLIP FOR SECURING CONTAINER SO AS TO PRECLUDE TAMPERING THEREWITH

BACKGROUND OF THE INVENTION

The present invention relates to a display clip for securing a container to a display card in such a manner as to prevent movement of the container with respect to the display card, while at the same time preventing removal of the cover of the container so as to prevent tampering with the contents of the container.

In the past, various techniques for mounting a container on, and securing it to, a display card have been employed. For example, such prior art techniques have called for the utilization of various means for restraining movement of a container with respect to a display card on which it is mounted, such means including ribbons, tapes, elastic bands, etc.

More recent efforts to securely mount a container on a display card have involved the utilization of transparent clips (such as, those of thermoplastic material). One such technique has employed plastic clips, connected to a display card, not only to hold the container to the display card, but also to prevent easy removal of the container from the display card prior to sale to a customer. However, such a technique has not been found satisfactory in cases where the container has multiple parts. For example, in the case of a lipstick container, which typically includes a barrel portion (containing the lipstick pomade) and a container cover, thermoplastic bands have been fitted around a built up portion of the barrel portion of the container, so as to secure the barrel portion of the container to the display card. Whereas this technique has precluded easy removal of the entire container from the display card prior to sale to the customer, it has not precluded the customer from removing the container cover so as to sample (or otherwise tamper with) the contents (in this case, the lipstick pomade) within the container.

SUMMARY OF THE INVENTION

Therefore, the present invention is directed to overcoming this disadvantage of prior art techniques. That is to say, the display clip of the present invention is intended for securely mounting a multi-part container to a display card, not only for the purpose of preventing removal of the entire container from the display card prior to sale to the customer, but also for the purpose of preventing removal of the container cover and consequent tampering with the contents of the container.

More specifically, the present invention relates to a display clip for securely mounting a multi-part container to the display card so as to prevent relative movement between the container and the display card, and also to prevent separation of the container cover from the barrel portion of the container. The display clip of the present invention achieves this objective by means of flange-type projecting portions located at the upper and lower extremities of the display clip. Moreover, in accordance with the invention, the cover of the container is provided with a built up cover portion thereof, around which the upper flange projecting portion of the display clip fits in surrounding fashion, while the barrel portion of the container is provided with a built up barrel portion, around which the lower flange projecting portion of the display clip fits in surrounding fashion. In this manner, relative movement between the container cover and the barrel portion is precluded, thus preventing tampering with the contents of the container.

Accordingly, it is an object of the present invention to provide a display clip for securely mounting a multi-part container to a display card so as to preclude relative movement between the container and the display card, while at the same time precluding separation of the parts of the container, thus preventing tampering with the contents of the container.

It is an additional object of the present invention to provide a display clip having upper and lower flange projecting portions which surround corresponding built up portions on corresponding first and second parts, respectively, of the container.

The above and other objects which will hereinafter appear, and the nature of the invention, will be more clearly understood by reference to the following description, the appended claims, and the accompanying drawings.

DETAILED DESCRIPTION

The present invention will now be more fully described with reference to FIG. 1, which is a perspective of a display clip for securely mounting a container on a display card.

Figure 1:
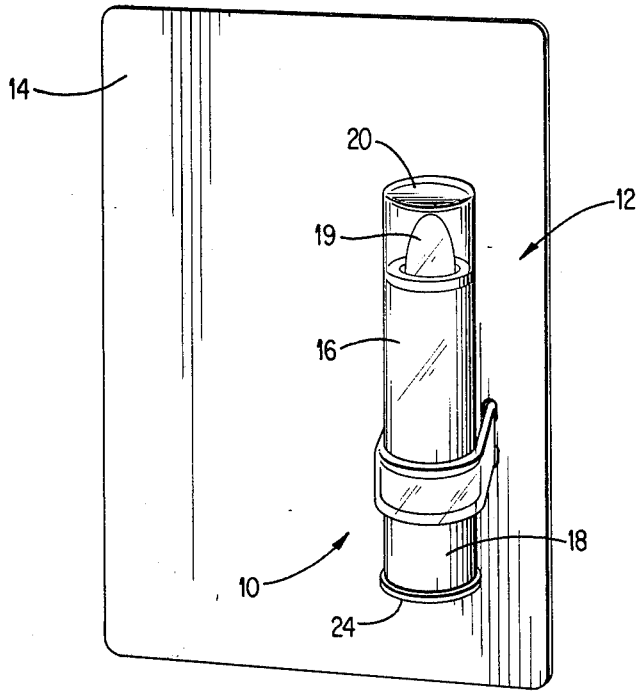
FIG. 1 is a perspective view of a display clip for securely mounting a multi-part container on a display card.

As seen in FIG. 1, the display clip 10 is employed for securely mounting a container 12 on a display card 14. The container 12 is a multi-part container, such as a lipstick container including a cover 16, a barrel portion 18, and a pomade 19. Although a lipstick container is shown in this specific example, it is to be understood that the display clip 10 can be employed to securely mount any similar multi-part container to a display card, while at the same time preventing separation of the portions of the multi-part container. Moreover, whereas the container 12, as shown in FIG. 1, has a cover 16 which is transparent, it is to be recognized that, of course, any type of cover (whether opaque or transparent) can be employed.

The present invention will now be described in more detail, with reference to FIGS. 2 through 5 of the drawings.

Figure 2:
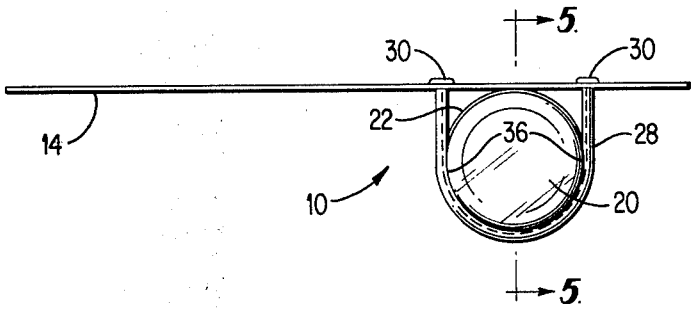
FIG. 2 is a top view of the display clip, container and display card of FIG. 1.
Figure 3:
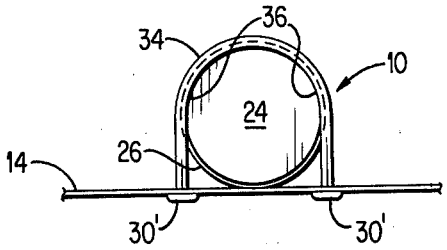
FIG. 3 is a bottom view of the display clip, container and display card of FIG. 1.
Figure 4:
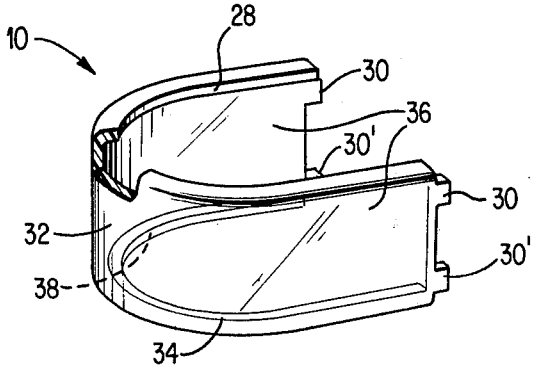
FIG. 4 is a perspective view of the display clip of FIG. 1.

As seen in FIGS. 2, 3 and 4 of the drawings, the display clip 10 has an upper flange projecting portion 28 (see FIGS. 2 and 4) located at an upper portion of the display clip 10, as well as a lower flange projecting portion34 (see FIGS. 3 and 4) located at a lower portion of the display clip 10.

Figure 5:
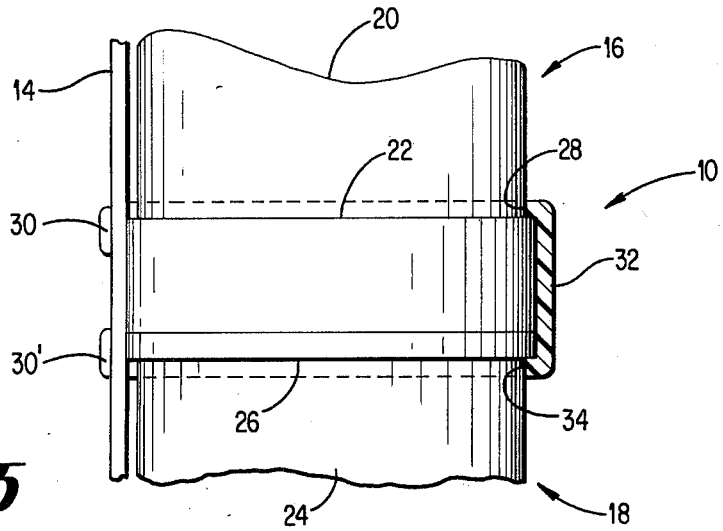
FIG. 5 is a side view of the display clip, container (a portion thereof) and the display card of FIG. 1.

As can be best seen in FIG. 5, the container 12 has a cover 16 and a barrel portion 18, the cover 16 including a built up cover, abutment or engagement portion 22 having a diameter which exceeds the diameter of the upper cover portion 20 of the cover 16. In addition, the barrel portion 18 of container 12 includes a built up barrel, abutment or engagement portion 26 having a diameter which exceeds the diameter of the lower barrel portion 24.

As also best seen in FIG. 5, display clip 10 is constructed so as to securely fit around the built up cover portion 22 and the built up barrel portion 26 of the container 12. Moreover, as seen in FIGS. 4 and 5, the display clip 10 has a front surface portion 32 which precludes movement of the container 12 away from the display card 14, that is, movement of the container 12 in a horizontal direction perpendicular, or generally perpendicular, to the display card 14. The display clip 10 also includes side portions 36 (FIGS. 2, 3 and 4) which prevent horizontal movement of the container 12 in directions parallel to the plane of the display card 14.

In addition, with reference to FIGS. 4 and 5, the display clip 10 includes upper flange projecting portion 28 and lower flange projecting portion 34 which, as previously mentioned, securely fit around built up cover portion 22 and built up barrel portion 26 of container 12 so as to accomplish two objectives:

(1) prevention of removal of the container 12, as a whole, from its position as mounted on display card 14; and (2) prevention of separation of the cover 16 of container 12 from the barrel portion 18 thereof, thus preventing tampering with the contents of the container 12.

Referring to FIG. 4, which is a perspective view of the display clip 10 of FIG. 1, display clip 10 includes tab portions 30 and 30' which project from the rear portions of the display clip 10. Further referring to FIGS. 2 and 4, tab portions 30 and 30' are provided in order to securely fix the display clip 10 to the display card 14, thus securely mounting the container 12 thereon. In the preferred embodiment, the tabs 30 and 30' are made of thermoplastic material, such that, upon being inserted in openings provided on the display card 14, and then being subjected to heat and/or pressure, the tabs 30 become flattened out on the rear surface of the display card 14, thus securely connecting the display clip 10 to the display card 14. Whereas the latter constitutes one particular way of fixing the display clip 10 to the display card 14, it is to be understood that various other conventional techniques for securely connecting the display clip 10 to the display card 14 may be employed.

Although preferred forms and arrangements have been shown and illustrated in the invention, it is to be clearly understood that various changes in detail and arrangement may be made without departing from the spirit and scope of this disclosure.

What is claimed is:

1. A cosmetic container and display assembly comprising in combination:

a display card; cosmetic container; and display clip means; said cosmetic container and display clip means including cooperating portions retaining the container on said display card, restricting said container against movement away from said display card, and preventing unauthorized opening and access to the contents of said container, the improvement in which:

said cosmetic container comprises at least two, separable container parts which must be separated to gain access to the container contents, each of said container parts respectively including built up separate abutment portions in proximity to each other when the container means is closed and its contents are not accessible, and said built up container parts projecting outwardly from the separable container parts, said display clip means comprising a member having spaced flanges embracing the closed container parts and disposed in spaced relation at opposite sides of said built up abutment portions and abutingly preventing separation thereof while engaging said built up portions of said container parts whereby separation and unauthorized access to the contents of said container means is prevented.

2. A container and assembly as claimed in claim 1 wherein said display clip means comprises a one-piece, integral element with inwardly projecting portions and clip means including terminal portions projecting through said display card and fixedly secured thereto.

3. A container and assembly as claimed in claim 1 wherein said display clip means comprises a transparent material.

4. A container and assembly as claimed in claim 1 in which said cosmetic container is a lipstick container and in which one of said separable container parts includes a lip pomade, and the other of said separable container parts comprises a cover element for the first mentioned container part.

5. A container and assembly as claimed in claim 1 in which said display clip comprises a thermoplastic material.

6. The combination of a cosmetic container of at least two parts, a display card, and a substantially rigid display clip for securely mounting said container to said display card, said at least two parts of said container each including separate engagement means integral with each of said container parts, said display clip comprising spaced apart restraining means respectively coacting with said separate engagement means of said at least two parts of said container, the spaced apart restraining means both preventing vertical and horizontal movement of said container parts relative to said display card, and also preventing separationof said at least two parts of said container from each other, said display clip further comprising means for connecting said display clip and cosmetic container to said display card whereby the container parts are retained intact and unauthorized access to the container contents is inhibited.

7. The combinationof claim 6 wherein said retaining means includes an uppermost horizontal portion and a lowermost horizontal portion interconnected as part of a one-piece molded display clip.

8. The combination of claim 1 wherein said retaining means includes an uppermost horizontal portion, a lowermost horizontal portion, said means for connecting comprising tabs extending rearwardly from said display clip through openings in said display card.

* * * * *